US005829541A

United States Patent [19]

Flood et al.

[11] Patent Number: 5,829,541

[45] Date of Patent: Nov. 3, 1998

[54] POLYCRYSTALLINE DIAMOND CUTTING ELEMENT WITH DIAMOND RIDGE PATTERN

[75] Inventors: Gary Martin Flood, Winchester; David Mark Johnson, Westerville; Friedel Siegfried Knemeyer, Granville; Bradley Earl Williams, Worthington, all of Ohio

[73] Assignee: General Electric Company, Pittsfield, Mass.

[21] Appl. No.: 777,222

[22] Filed: Dec. 27, 1996

[51] Int. Cl.[6] ..... E21B 10/46

[52] U.S. Cl. ..... 175/426; 175/432

[58] Field of Search ..... 175/426, 430, 175/431, 432, 434

[56] References Cited

U.S. PATENT DOCUMENTS

| | | | |
|---|---|---|---|
| 3,136,615 | 6/1964 | Bovenkerk et al. . | |
| 3,141,746 | 7/1964 | De Lai . | |
| 3,233,988 | 2/1966 | Wentorf, Jr. et al. . | |
| 3,743,489 | 7/1973 | Wentorf, Jr. et al. . | |
| 3,745,623 | 7/1973 | Wentorf, Jr. et al. . | |
| 3,767,371 | 10/1973 | Wentorf, Jr. et al. . | |
| 4,109,737 | 8/1978 | Bovenkerk . | |
| 4,724,913 | 2/1988 | Morris | 175/430 |
| 4,872,520 | 10/1989 | Nelson | 175/430 |
| 5,172,777 | 12/1992 | Siracki et al. | 175/430 X |
| 5,322,138 | 6/1994 | Siracki | 175/426 X |
| 5,329,854 | 7/1994 | Komstadius et al. . | |
| 5,374,854 | 12/1994 | Chen . | |
| 5,486,137 | 1/1996 | Flood et al. | 175/432 X |
| 5,564,511 | 10/1996 | Frushour | 175/434 X |
| 5,655,612 | 8/1997 | Grimes et al. | 175/426 X |
| 5,709,279 | 1/1998 | Dennis | 175/432 X |

FOREIGN PATENT DOCUMENTS

| | | | |
|---|---|---|---|
| 1352033 | 11/1987 | U.S.S.R. | 175/426 |

*Primary Examiner*—William P. Neuder

[57] ABSTRACT

This invention relates to a novel domed polycrystalline diamond cutting element wherein a hemispherical diamond layer is bonded to a tungsten carbide substrate, commonly referred to as a tungsten carbide stud. Broadly, a pattern of ridges or bumps is integrally formed in the abrasive layer which ridges are designed to cause high localized stresses in the rock, thus starting a crack. By initiating cracks in localized areas, the crushing action could be performed with less force.

20 Claims, 6 Drawing Sheets

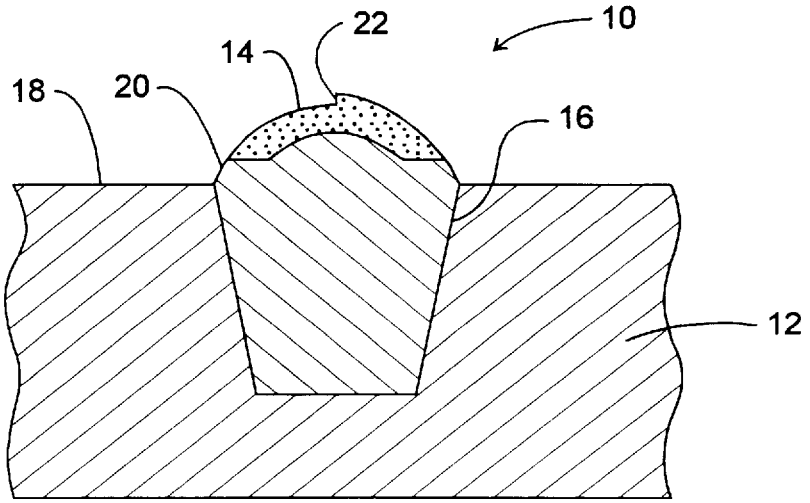
FIG. 1
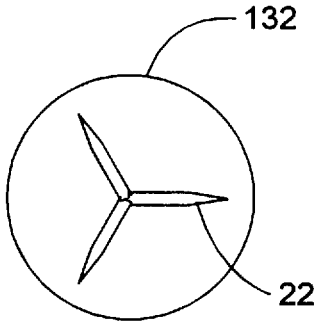
FIG. 2
FIG. 3
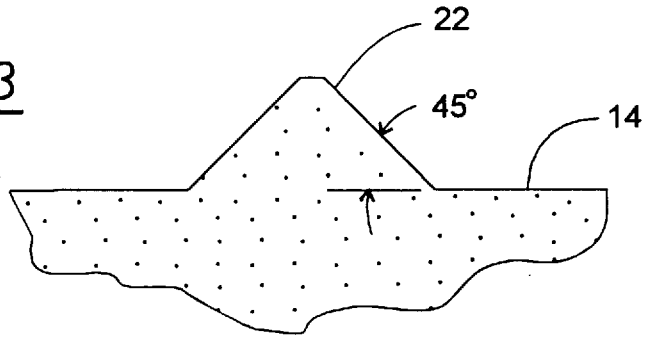

POLYCRYSTALLINE DIAMOND CUTTING ELEMENT WITH DIAMOND RIDGE PATTERN

CROSS REFERENCE TO RELATED APPLICATIONS

This application is cross-referenced to commonly-assigned application Ser. No. 08,777,213, filed on Dec. 27, 1996, entitled "Polycrystalline Diamond Cutting Element", which is a continuation-in-part application of commonly-assigned application Ser. No. 08/645398, filed on Apr. 13, 1996 herewith (attorney docket 60SD-760), entitled "Polycrystalline Diamond Cutting Element", (now abandoned) the disclosure of which is expressly incorporated herein by reference.

BACKGROUND OF THE INVENTION

The present invention relates to implements incorporating abrasive particle compacts and more particularly to a novel stud-mounted domed abrasive compact having a design geometry that results in the crushing action being performed with less force. Such implements have special utility in drill bits for oil and gas exploration and in mining applications.

An abrasive particle compact is a polycrystalline mass of abrasive particles, such as diamond and/or cubic boron nitride, bonded together to form an integral, tough, high-strength mass. Such components can be bonded together in a particle-to-particle self-bonded relationship, by means of a bonding medium disposed between the particles, or by combinations thereof. For example, see U.S. Pat. Nos. 3,136,615, 3,141,746, and 3,233,988. A supported abrasive particle compact, herein termed a composite compact, is an abrasive particle compact which is bonded to a substrate material, such as cemented tungsten carbide. Compacts of this type are described, for example, in U.S. Pat. Nos. 3,743,489, 3,745,623, and 3,767,371. The bond to the support can be formed either during or subsequent to the formation of the abrasive particle compact.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. Particularly, U.S. Pat. Nos. 4,109,737 and 5,374,854, describe drill bits with a tungsten carbide stud (substrate) having a polycrystalline diamond compact on the outer surface of the cutting element. A plurality of these cutting elements then are mounted generally by interference fit into recesses into the crown of a drill bit, such as a rotary drill bit. These drill bits generally have means for providing water cooling or other cooling fluids to the interface between the drill crown and the substance being drilled during drilling operations. Generally, the cutting element comprises an elongated pin of a metal carbide (stud) which may be either sintered or cemented carbide (such as tungsten carbide) with an abrasive particle compact (e.g., polycrystalline diamond) at one end of the pin for forming a composite compact.

As disclosed and shown in the prior art, the polycrystalline diamond layer covers the complete cutting surface of the abrasive cutting elements that are employed in a rotary drill, drag, percussion, or machining bits. Rotary drill bits also are known as roller cones. The diamond layer extends to the surface of the drill bit holding the cutting elements. This is shown in U.S. Pat. Nos. 4,109,737 and 5,329,854. Simply, the diamond layer covers the entire exposed (cutting) surface or radius of the exposed end of the cutting or abrading element.

BRIEF SUMMARY OF THE INVENTION

This invention relates to a novel domed polycrystalline diamond cutting element wherein a hemispherical diamond layer is bonded to a tungsten carbide substrate, commonly referred to as a tungsten carbide stud. Broadly, a pattern of ridges or bumps is integrally formed in the abrasive layer which ridges are designed to cause high localized stresses in the rock, thus starting a crack. By initiating cracks in localized areas, the crushing action could be performed with less force.

BRIEF DESCRIPTION OF THE DRAWINGS

FIG. 1 shows a cross-sectional view of a cutting element where the diamond dome contains a ridge pattern;

FIG. 2 is a top view of the cutting element depicted at FIG. 1;

FIG. 3 is an enlarged view of the ridges depicted at FIG. 2 and 2;

Figure 4:
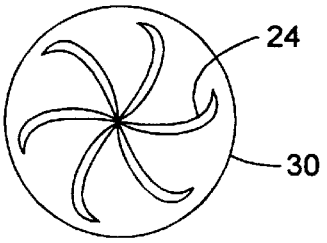
FIG. 4 is a top view of another ridge pattern like that depicted at FIG. 2.

The drawings will be described in detail below.

DETAILED DESCRIPTION OF THE INVENTION

Referring initially to FIG. 1, cutting element 10 is shown disposed in drill bit body 12 which is only partially shown. Cutting element 10 is interference fitted into a recess in bit body 12. Cutting element 10 is composed of polycrystalline diamond dome 14 affixed to carbide stud 16. Diamond dome 14 may not cover all of the exposed hemispherical end of stud 16 that extends above outer surface 18 of stud 16, revealing carbide annulus 20, as proposed in application Ser. No. 08/645398, cross-referenced above; or it may cover all of the exposed hemispherical end of stud 16 in conventional fashion (see FIGS. 8–17). In the practice of the present invention, a surprising feature is the unexpected improvement in cutting action to be realized by dint of the integrally formed ridges in the abrasive layer which are designed to cause high localized stresses in the rock, thus starting a crack. By initiating cracks in localized areas when used in, for example, a drill bit configuration, the crushing action would be performed with less force. It also can be envisioned how larger cracks also may result in larger chips. Such action, by its very nature, would indicate better cutting efficiencies since the rock-to-rock bond breakage per volume of rock removed decreases.

As disclosed herein, the surface of the polycrystalline diamond layer may be domed, hemispherical, hemispherical of reduced radius or hemispherical with a series of flats formed thereon, such as shown in application Ser. No. 08/645398, cross-referenced above. The interface between the diamond dome and the carbide support stud similarly can take on a variety of configurations for improving the attachment between the diamond layer and the carbide support.

Figure 5:
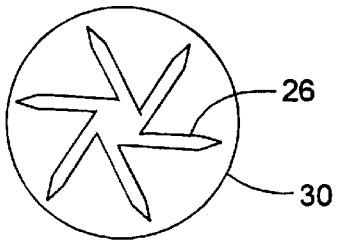
FIG. 5 is a top view of yet another ridge pattern like that depicted at FIG. 2.
Figure 6:
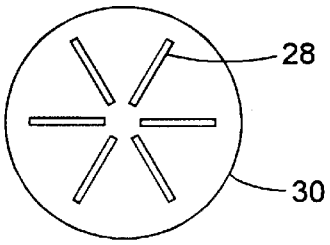
FIG. 6 is a top view of a further ridge pattern like that depicted at FIG. 2.

Referring again specifically to FIG. 1, abrasive dome 14 is seen to bear ridge 22 which is part of a spoked pattern as depicted at FIG. 2. A radial cross-section of ridge 22 is seen at FIG. 3. It is preferred that ridge 22 have an angle of 45° with respect to dome 14, though other angles can be used with more or less efficacy. The placement and pattern of the ridges will be determined by the specific application. Additional ridge patterns 24, 26, and 28 formed into abrasive dome 30, are depicted at FIGS. 4, 5, and 6, respectively. It will be appreciated that a variety of additional patterns may be designed and prove quite efficacious in use based on the disclosure herein. Such additional designs are considered to be within the precepts of the present invention.

Figure 7:
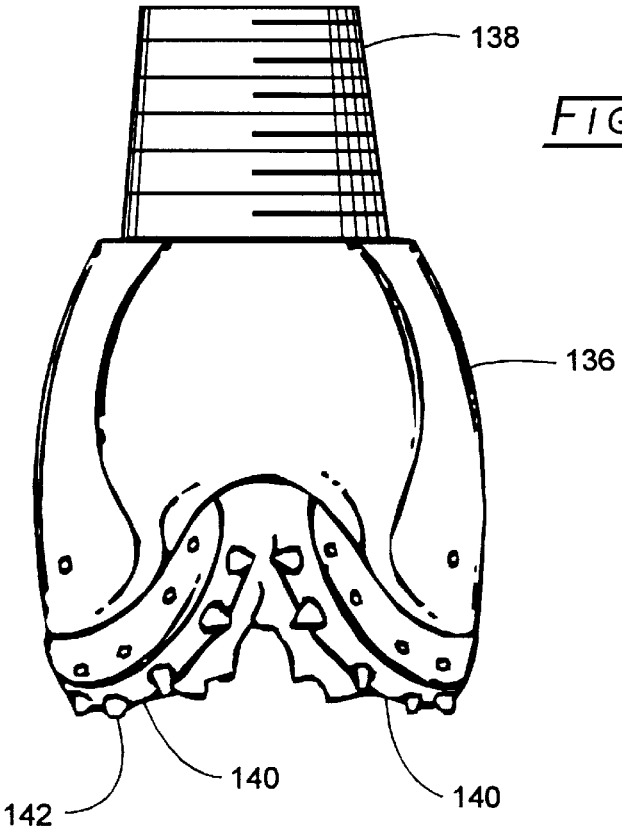
FIG. 7 is a side elevational view of an improved roller-cone drill bit employing the novel cutting elements of the present invention.

FIG. 7 depicts a conventional roller cone drill bit composed of metal drill body 136 having threaded end 138 and three (only two shown in the drawing) cutter cones 140 (thus, a tri-cone roller bit, as it sometimes in known in the field). Each cutter cone retains a plurality of cutter elements, cutting element 142 labeled for reference. Such cutting elements are those novel cutting elements of the present invention.

The polycrystalline dome layer preferably is polycrystalline diamond (PCD). However, other materials that are included within the scope of this invention are synthetic and natural diamond, cubic boron nitride (CBN), wurtzite boron nitride, combinations thereof, and like materials. Polycrystalline diamond is the preferred polycrystalline layer. The cemented metal carbide substrate is conventional in composition and, thus, may be include any of the Group IVB, VB, or VIB metals, which are pressed and sintered in the presence of a binder of cobalt, nickel or iron, or alloys thereof. The preferred metal carbide is tungsten carbide.

Further, in the practice of this invention, while the surface configuration of the diamond layer is not critical, it is preferred that the layer be essentially hemispherical. The surface configuration of the diamond layer also may be conical, reduced or increased radius, chisel, or non-axisymmetric in shape. In general, all forms of tungsten carbide inserts used in the drilling industry may be enhanced by the addition of a diamond layer, and further improved by the current invention by addition of a pattern of ridges, as disclosed herein.

Further, the interface between the carbide and diamond layer may be of generally any configuration such as domed, hemispherical, reduced radius, flat, cone-shaped, etc. The interface may also be smooth, serrated, or the like. However, an irregular interfacial surface is preferred since it provides better bonding between the diamond layer and carbide substrate particularly during sintering of the carbide substrate and forming of the diamond layer. In this regard, reference is made to FIGS. 8–17.

Figure 8:
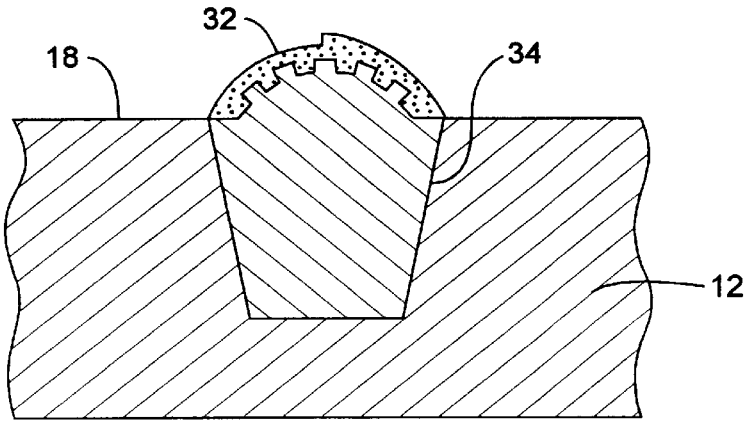
FIG. 8 is a cross-sectional view of another embodiment of a cutting element where the diamond dome-carbide stud interface has a square sawtooth configuration.

In FIG. 8, diamond dome 32 is attached to carbide stud 34 revealing carbide annulus 36. The outer end of stud 34 bears square grooves for improving the attachment of diamond dome 32 thereto.

Figure 9:
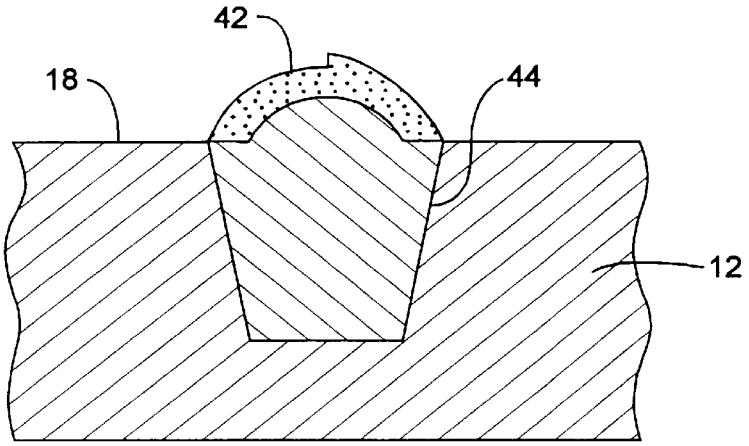
FIG. 9 is a cross-sectional view of another embodiment of a cutting element where the out interface between the diamond dome and the carbide stud is flat.

In FIG. 9, diamond dome 42 is attached to carbide stud 44 revealing carbide annulus 46. In this configuration, however, the outer attachment area between diamond dome 42 and carbide 44 is flat (flat annulus).

Figure 10:
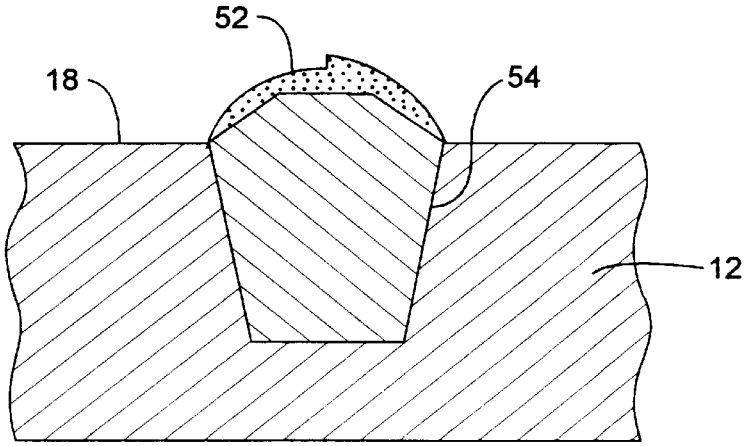
FIG. 10 is a cross-sectional view of another embodiment of a cutting element where the carbide hemispherical end has flats to which the diamond dome is bonded.

In FIG. 10, the outer end of carbide stud 54 is flat on top with an outer flat annulus. Diamond dome 52 is attached to such flats revealing carbide annulus 56.

Figure 11:
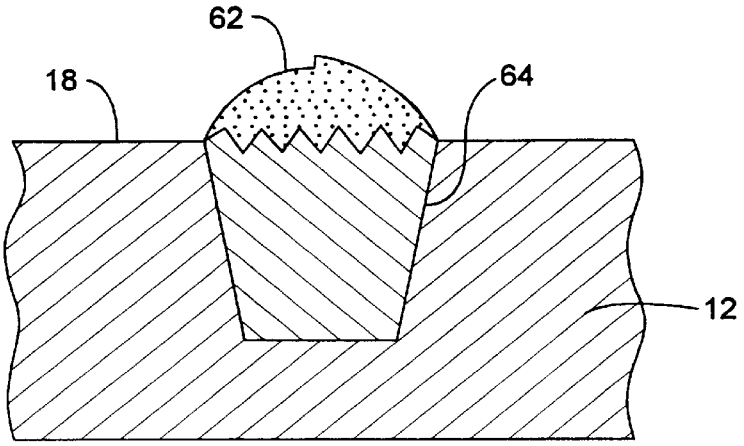
FIG. 11 is a cross-sectional view of another embodiment of a cutting element where the diamond dome-carbide interface is saw-tooth in configuration with the interface sloping upward at the edge.

In FIG. 11, a substantially plane saw-tooth end of carbide pin 64 forms the interface between it and diamond dome 62 wherein the carbide slopes upwardly away from drill body 12 at its interface with diamond dome 62. Carbide annulus 66 still is present.

Figure 12:
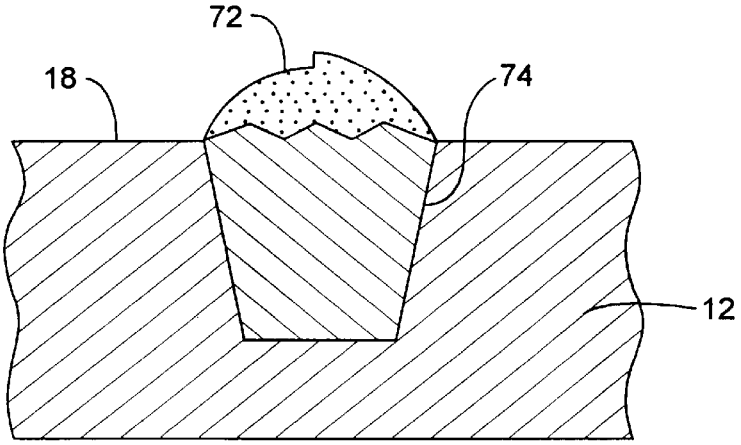
FIG. 12 is a cross-sectional view of another embodiment of a cutting element where the diamond dome-carbide interface is saw-tooth in configuration with the interface sloping downward at the edge.

In FIG. 12, a substantially plane saw-tooth end of carbide pin 64 forms the interface between it and diamond dome 62 wherein the carbide slopes downwardly towards from drill body 12 at its interface with diamond dome 62. Carbide annulus 66 still is present.

Figure 13:
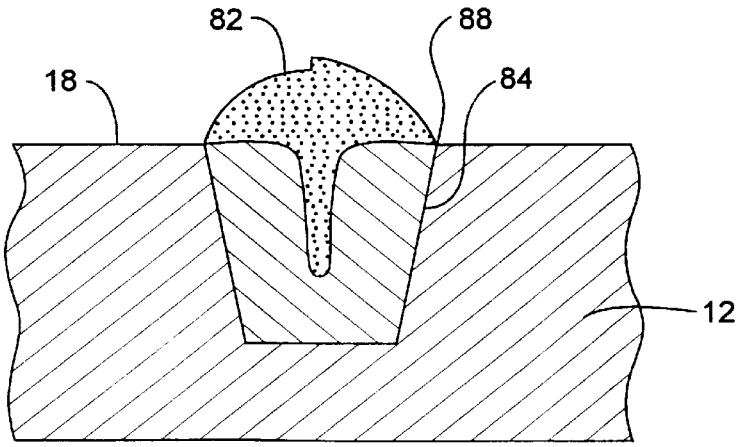
FIG. 13 is a cross-sectional view of another embodiment of a cutting element where the diamond dome has a pillar that extends down into the center of the carbide stud.

In FIG. 13, diamond dome 82 has pillar 88 that extends into carbide stud 84. Carbide annulus 86 still is revealed. Note, that pillar 88 may be formed from coarser diamond grit than the remainder of diamond dome 82.

Figure 14A:
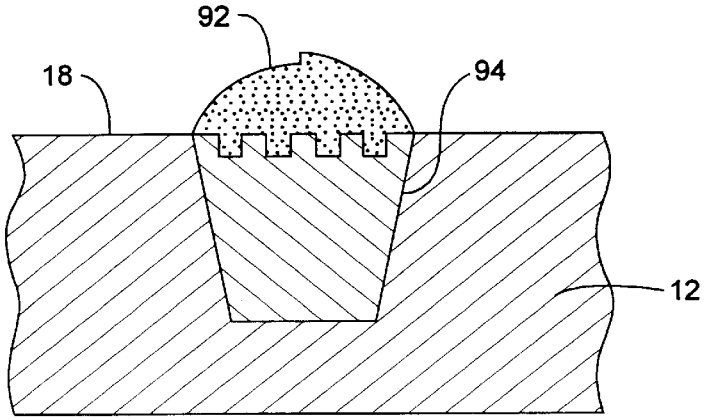
FIG. 14*a* is a cross-sectional view of another embodiment of a cutting element where the substantially flat carbide end with square grooves extending across such end as depicted at FIG. 14*b;*
Figure 14B:
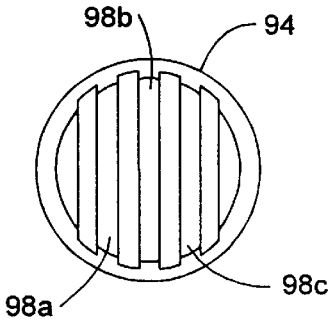

In FIG. 14*a*, carbide stud 94 contains square grooves 98*a–d* (see FIG. 14*b*) across its substantially flat outer surface for improving attachment to diamond dome 92. Carbide annulus 96 still is present.

Figure 15A:
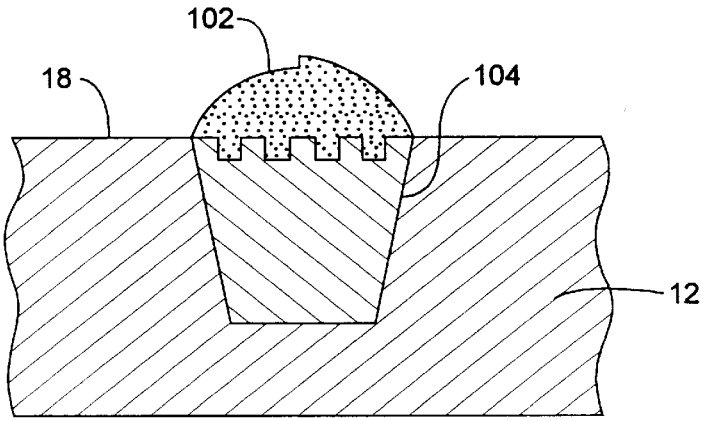
FIG. 15*a* is a cross-sectional view of another embodiment of a cutting element where the substantially flat carbide end with square annual groves as depicted at FIG. 15*b;*
Figure 15B:
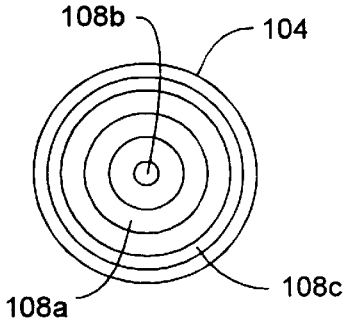

In FIG. 15*a*, carbide stud 104 contains annular square grooves 108*a–b* (see FIG. 15*b*) across its substantially flat outer surface for improving attachment to diamond dome 102. Carbide annulus 106 still is present.

Figure 16A:
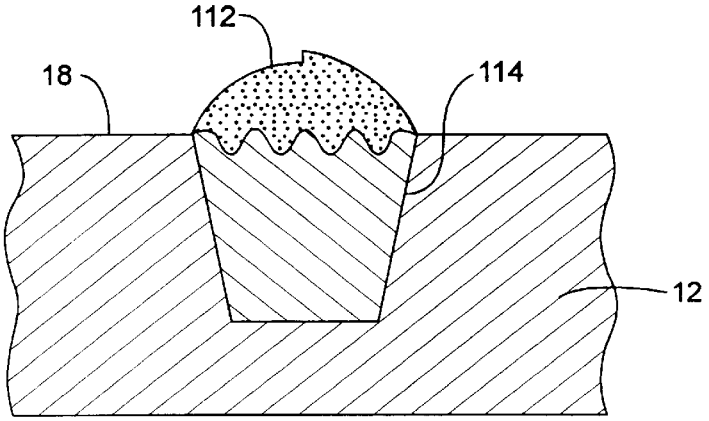
FIG. 16*a* is a cross-sectional view of another embodiment of a cutting element where the substantially flat carbide end with sinusoidal grooves extending across such end as depicted at FIG. 16*b*.
Figure 16B:
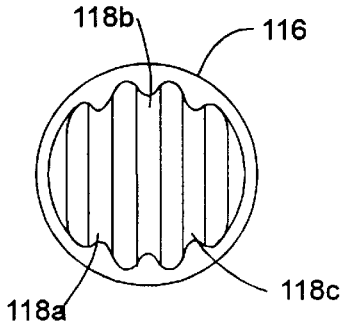

In FIG. 16*a*, carbide stud 114 contains sinusoidal grooves 118*a–d* (see FIG. 16*b*) across its substantially flat outer surface for improving attachment to diamond dome 112. Carbide annulus 116 still is present.

Figure 17A:
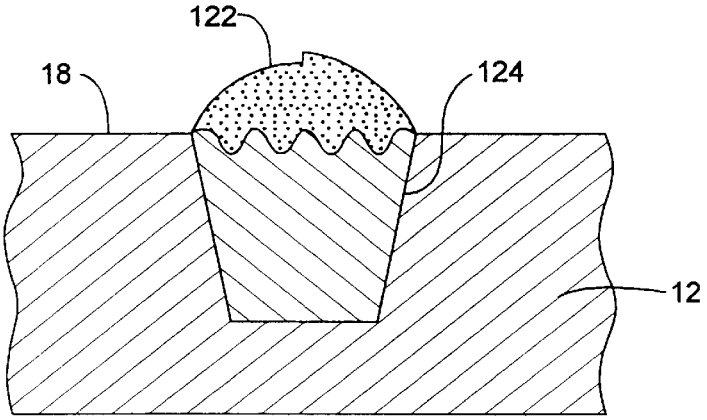
FIG. 17*a* is a cross-sectional view of another embodiment of a cutting element where the substantially flat carbide end with annual sinusoidal grooves as depicted at FIG. 17*b*.
Figure 17B:
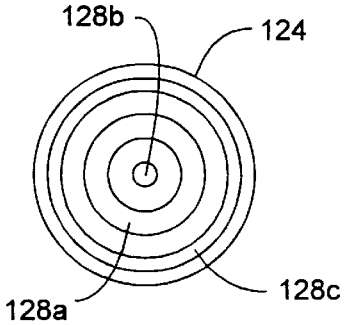

In FIG. 17*a*, carbide stud 124 contains sinusoidal annular grooves 128*a–b* (see FIG. 17*b*) across its substantially flat outer surface for improving attachment to diamond dome 122. Carbide annulus 126 still is present.

While the invention has been described and illustrated in connection with certain preferred embodiments thereof, it will be apparent to those skilled in the art that the invention is not limited thereto. Accordingly, it is intended that the appended claims cover all modifications which are within the spirit and scope of this invention. All references cited herein are expressly incorporated herein by reference.

We claim:

1. A cutting element which comprises:

(a) a metal carbide stud having a proximal end adapted to be placed into a drill bit and having a distal end portion; and (b) a layer of cutting polycrystalline abrasive material disposed over said distal end portion, wherein said layer of polycrystalline abrasive material bears a pattern of raised ridges.

2. The cutting element of claim 1, wherein said polycrystalline abrasive material is polycrystalline diamond.

3. The cutting element of claim 1, wherein said metal carbide is tungsten carbide.

4. The cutting element of claim 1, wherein the interface between the metal carbide stud and the polycrystalline abrasive material is non-planar.

5. The cutting element of claim 4, wherein the interface between the metal carbide stud and the polycrystalline abrasive material is serrated.

6. The cutting element of claim 5, wherein the serrated interface is linear.

7. The cutting element of claim 5, wherein the serrated interface is annular.

8. The cutting element of claim 4, wherein the outermost interface intersection slopes upward away from the drill bit.

9. The cutting element of claim 4, wherein the outermost interface intersection slopes downward towards the drill bit.

10. The cutting element of claim 4, wherein a polycrystalline abrasive material pillar extends downward into the center of said metal carbide stud.

11. The cutting element of claim 1, wherein the polycrystalline abrasive layer is essentially hemispherical.

12. The cutting element of claim 1, wherein said metal carbide stud is selected from the group consisting essentially of Group IVB, Group VB, and Group VIB metal carbides, and the polycrystalline abrasive material is selected from the group consisting essentially of diamond, cubic boron nitride, wurtzite boron nitride, and combinations thereof.

13. The cutting element of claim 1, wherein said pattern is star-shaped with arms that project radially from the center of the polycrystalline abrasive layer.

14. In a drill bit of an elongate drill bit body having recesses for retaining cutting elements, the improvement which comprises said cutting elements comprising:

(a) a metal carbide stud having a proximal end placed into the recesses of said drill bit body and having a distal end portion; and (b) a layer of cutting polycrystalline abrasive material disposed over said distal end portion, wherein said layer of polycrystalline abrasive material bears a pattern of raised ridges.

15. The improved drill bit of claim 14, wherein the polycrystalline abrasive is diamond.

16. The improved drill bit of claim 14, wherein the polycrystalline abrasive is cubic boron nitride.

17. The improved drill bit of claim 14, wherein the drill bit is a rotary drill bit.

18. The improved drill bit of claim 14 wherein the polycrystalline abrasive layer of the cutting element is essentially hemispherical.

19. The improved drill bit of claim 14, wherein the interface between the metal carbide stud and the polycrystalline abrasive material is non-planar.

20. The improved drill bit of claim 14, wherein said pattern is star-shaped with arms that project radially from the center of the polycrystalline abrasive layer.

* * * * *